US007765643B2

(12) United States Patent
Vanini

(10) Patent No.: US 7,765,643 B2
(45) Date of Patent: Aug. 3, 2010

(54) CONNECTION FOR HINGE

(75) Inventor: Angelo Vanini, Bologna (IT)

(73) Assignee: Nuova Star S.p.A., Zola Predosa (IT)

( * ) Notice: Subject to any disclaimer, the term of this patent is extended or adjusted under 35 U.S.C. 154(b) by 646 days.

(21) Appl. No.: 11/727,232

(22) Filed: Mar. 26, 2007

(65) Prior Publication Data

US 2007/0232135 A1 Oct. 4, 2007

(30) Foreign Application Priority Data

Mar. 31, 2006 (IT) ..... BO20060029 U

(51) Int. Cl.
*E05F 1/08* (2006.01)

(52) U.S. Cl. ..... 16/286

(58) Field of Classification Search ..... 16/286, 16/289, 297, 335, 336, 343, 270, 271, 267, 16/266; 126/194, 191, 192, 193; 49/386, 49/387

See application file for complete search history.

(56) References Cited

U.S. PATENT DOCUMENTS 2,811,740 A * 11/1957 Bevilacqua ..... 16/335
3,003,495 A * 10/1961 Coultrip ..... 126/194
3,327,701 A * 6/1967 Smith ..... 126/194
3,503,380 A * 3/1970 Vasaturo ..... 126/191
3,842,542 A * 10/1974 White et al. ..... 49/386
4,001,973 A * 1/1977 Rice et al. ..... 49/386
4,665,892 A * 5/1987 Spargo et al. ..... 126/194
5,025,776 A * 6/1991 Hanley et al. ..... 126/194
5,822,925 A * 10/1998 McKinney et al. ..... 49/386
7,017,232 B1 * 3/2006 Priddy ..... 16/286
2003/0172920 A1 * 9/2003 Gronbach ..... 126/197

FOREIGN PATENT DOCUMENTS

EP 738817 A1 * 10/1996

* cited by examiner

*Primary Examiner*—Chuck Y. Mah
(74) *Attorney, Agent, or Firm*—The Nath Law Group; Jerald L. Meyer; Sungyeop Chung

(57) ABSTRACT

A connection for hinges of the type having two elements which can rotate relative to one another; the connection comprises a box-shaped body having a base wall and two parallel lateral walls, and can be stably connected to a fixed frame of an electrical appliance.

10 Claims, 5 Drawing Sheets

CONNECTION FOR HINGE

BACKGROUND OF THE INVENTION

The present invention relates to a connection for hinges.

In particular, the present invention relates to a connection for hinges for the wings and/or doors of electrical appliances such as ovens, dishwashers or the like.

In the following description and by way of example only, without limiting the scope of the invention, the present invention is described with reference to an oven.

As is known, connections for hinges may be connected without distinction to the fixed frame of the oven or to the oven door.

The most widespread solution is that in which the connection is connected to the fixed structure of the oven. Reference is made to that solution below.

The function of the above-mentioned connections is to form a housing for a first, fixed part of the hinge on which a relative second part pivots, the parts being rotatably connected so that they rotate relative to one another.

The second part is connected to an edge of the door and the relative movement between the two parts causes the door to open and close.

Such a type of link basically allows the oven door to move with a tilting action relative to the opening.

The first part is connected to the respective connection by one or more hooking elements positioned on the connection and designed to hold the first part fixed relative to the connection, during relative rotations between the two parts of the hinge.

In prior art connections, the hooking elements consist of rivets inserted in respective holes made in the sheet of which the connection usually consists.

The connection is normally of the box-shaped type and is made by forming and bending a suitable portion of sheet metal.

Therefore, during forming, the above-mentioned holes are also made to allow insertion of the rivets at a later step.

Therefore, production of the connections requires various separate operating steps and intervention by an operator to complete the connections, with a significant effect on production costs.

SUMMARY OF THE INVENTION

The present invention therefore has for an aim to overcome the above-mentioned disadvantages by providing a connection for hinges which is economical and easy to produce.

BRIEF DESCRIPTION OF THE DRAWINGS

The technical features of the invention, in accordance with the afore-mentioned aims, are clearly indicated in the claims herein and the advantages of the invention are more apparent in the detailed description which follows, with reference to the accompanying drawings, which illustrate a preferred embodiment by way of example only and without limiting the scope of the invention, in which:

DESCRIPTION OF THE PREFERRED EMBODIMENTS

Figure 1:
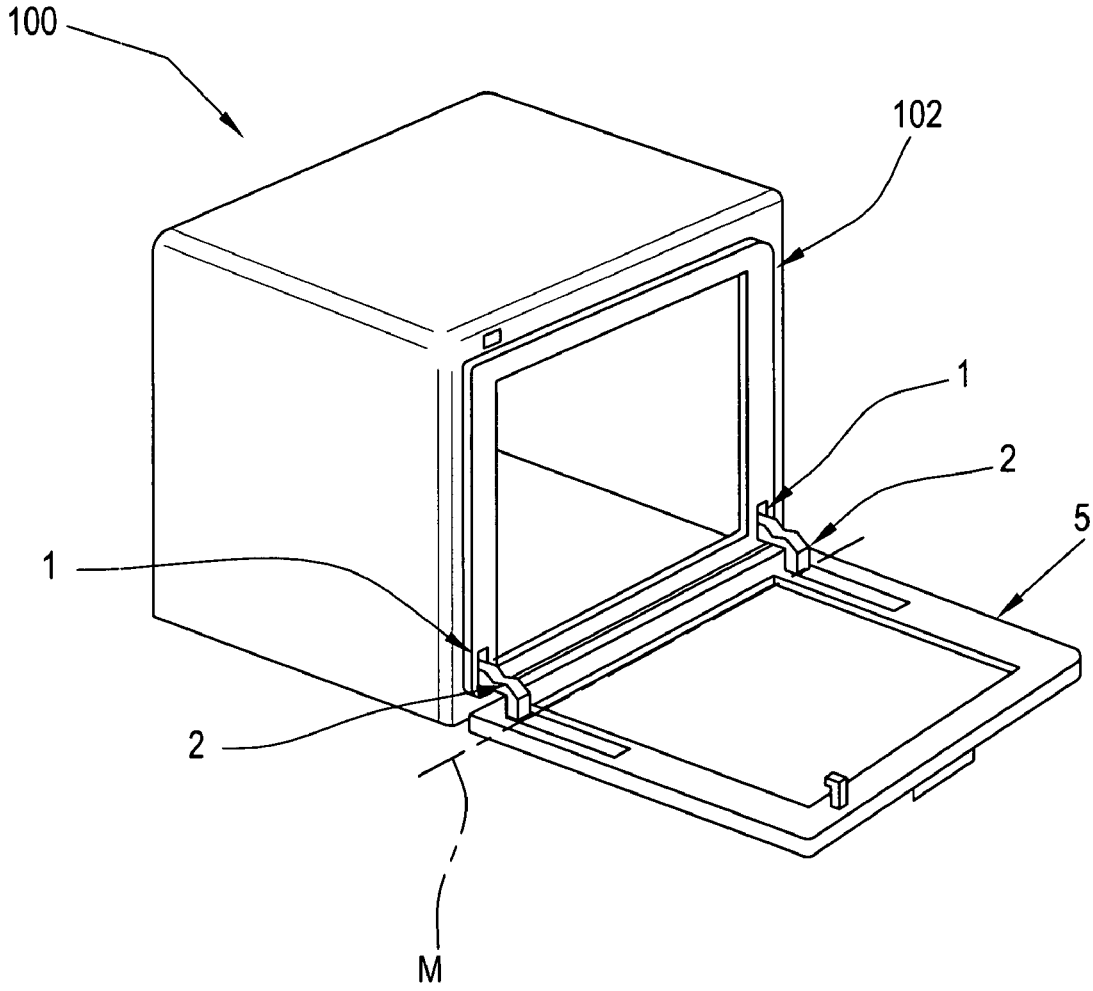
FIG. 1 is a schematic perspective view of an oven with a connection for hinges in accordance with the present invention.
Figure 2:
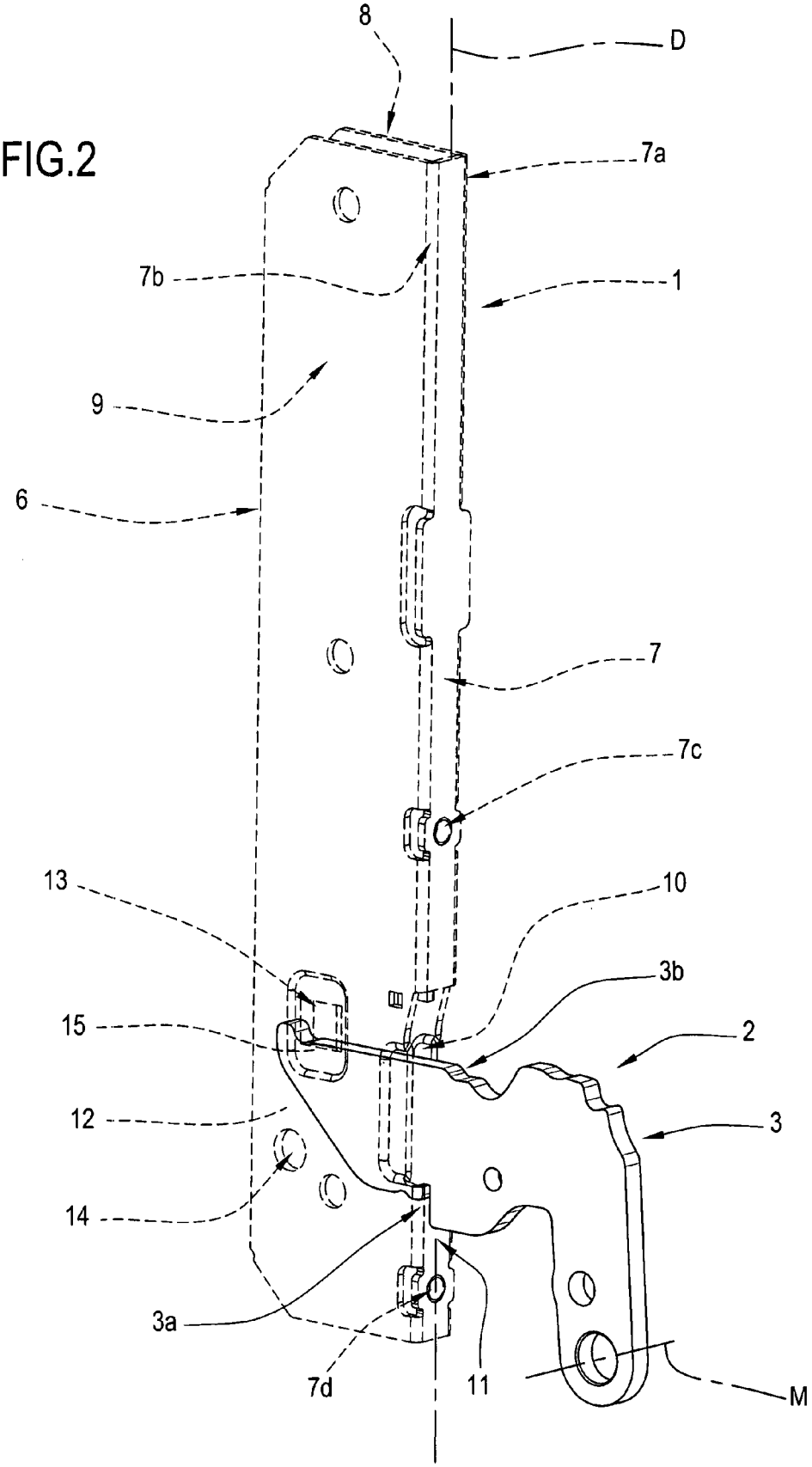
FIG. 2 is a schematic perspective view with some parts transparent to better illustrate others, of a connection in accordance with the present invention.
Figure 3:
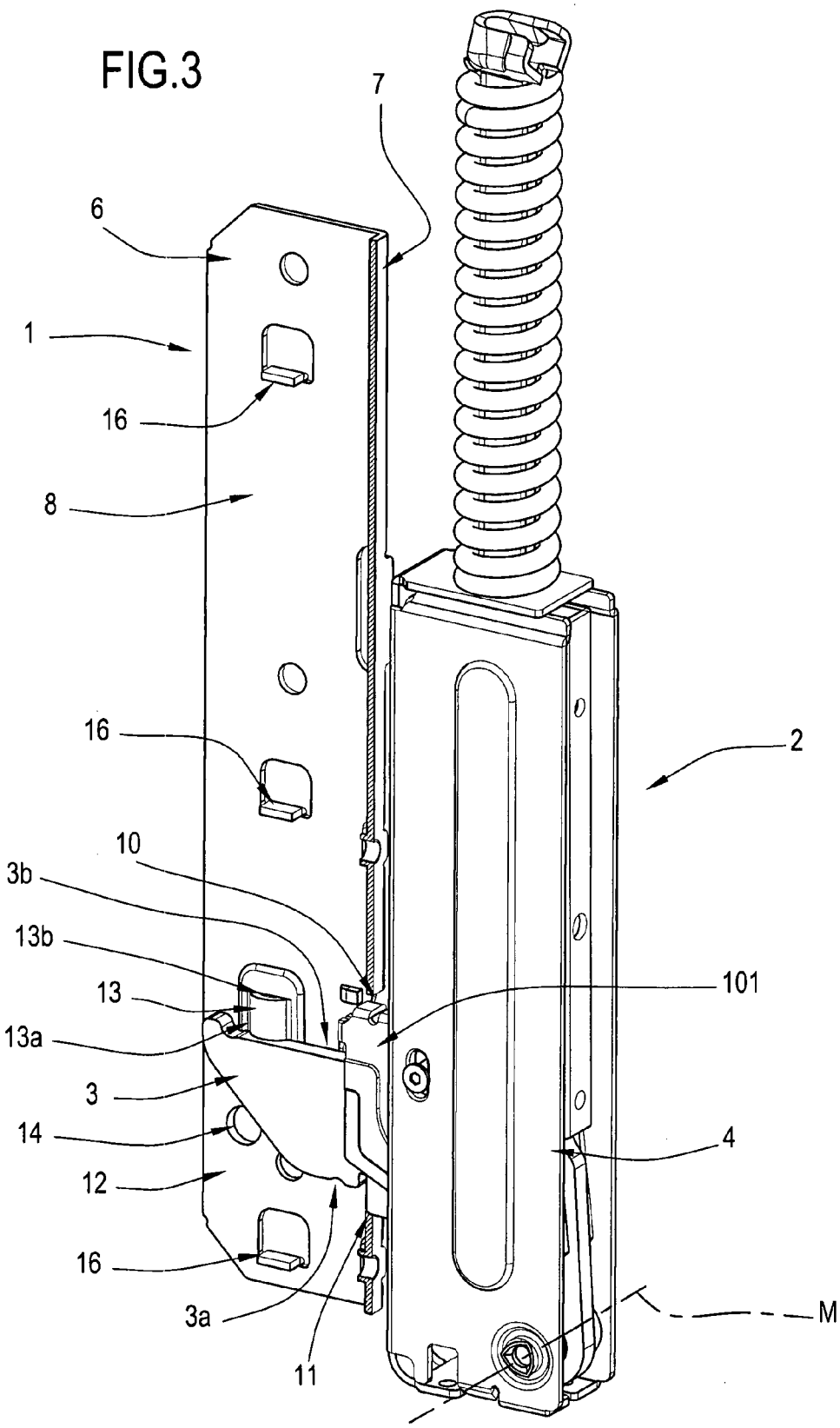
FIG. 3 is a schematic perspective view of a detail of the connection of FIG. 2, with some parts cut away to better understand others.

With reference to FIGS. 2 and 3, the numeral 1 denotes a connection for hinges 2 intended for use in electrical appliances, in particular in ovens, of the type illustrated in FIG. 1.

Ovens of the known type comprise a fixed frame 102 to which a door 5 is connected by two hinges 2 which allow the door to rotate with a tilting action about a horizontal axis M.

The hinges 2 comprise a first element 3, having a lower side 3*a* and an upper side 3*b*, for insertion in the connection 1 and a second element 4, pivoting on the first element 2 at a relative axis of rotation M.

The above-mentioned hinges also comprise an element 101 for fixing them to the connection 1.

The second element 4 is connected to the door 5 of the oven 100, this second element 4 allowing the door 5 to open and close, allowing it to rotate about the axis M relative to the oven 100 frame 102.

Figure 5:
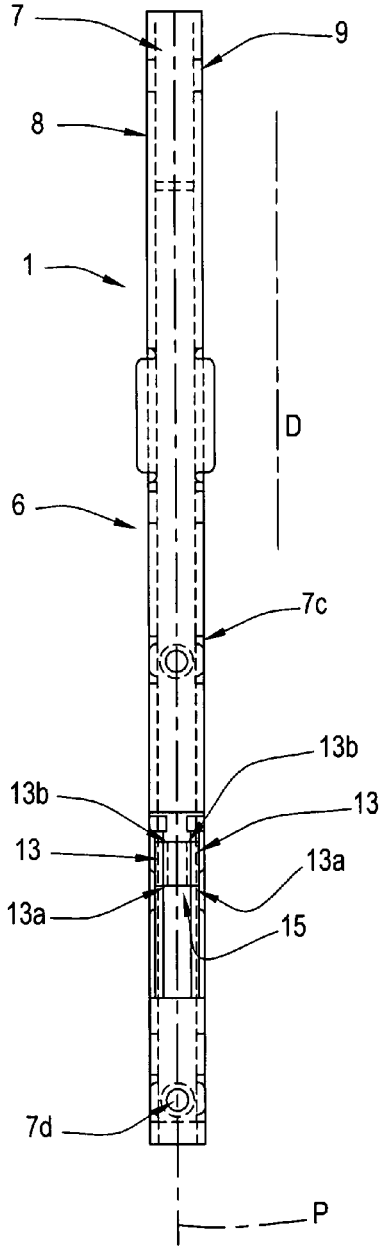
FIG. 5 is a front elevation view of the connection of FIG. 2.

As illustrated in FIGS. 2 and 5, the connection 1 comprises a box-shaped body 6 extending longitudinally in a predetermined direction D.

The box-shaped body 6 comprises a base wall 7 having two longitudinal sides 7*a*, 7*b*, and two lateral walls 8, 9, parallel and alongside one another, respectively connected to the first longitudinal side 7*a* and the second longitudinal side 7*b* of the wall 7.

Basically, the box-shaped body 6 has a C-shaped cross-section relative to its longitudinal extension.

Figure 4:
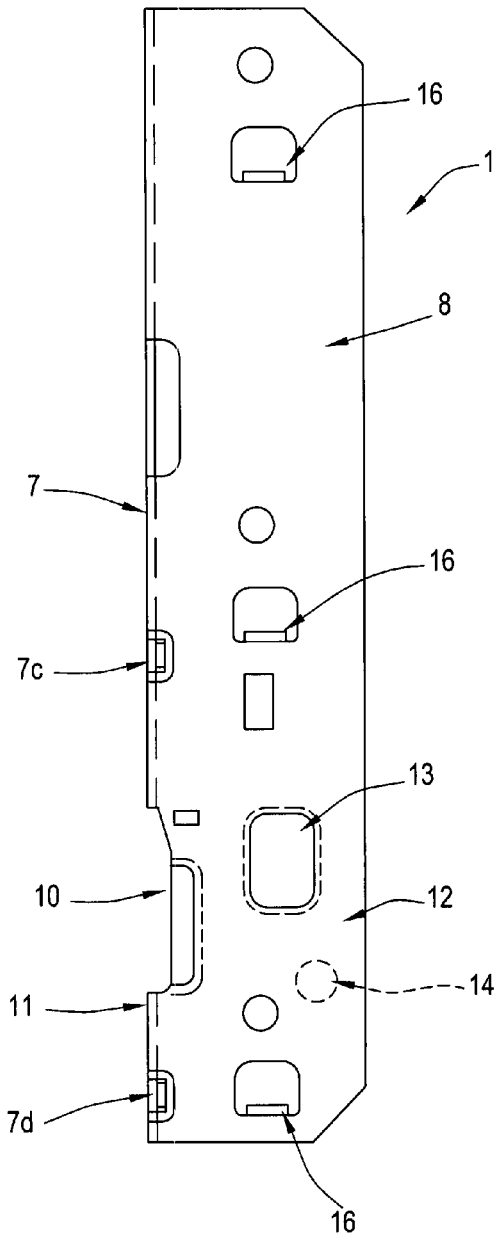
FIG. 4 is a side elevation view of the connection of FIG. 2.

With reference to FIGS. 2, 4 and 5, the base wall 7 has two holes 7*c*, 7*d* for the insertion of elements, such as screws or the like, not illustrated, for fixing the connection 1 to the oven 100 frame 102.

The base wall 7 also has an opening 10 for insertion of the first element 3 of the hinge 2 in the connection 1 and a lower portion 11 for connecting with the first element 3.

On the lower side 3*a* of the element 3 there is a notch designed to engage with the portion 11 of the base wall 7, said portion 11 forming a lower limit for the opening 10.

On each of the two lateral walls 8, 9 of the box-shaped body 6, at a lower part 12 of the latter, there is a first deformed portion 13 and a second deformed portion 14, these deformed portions 13, 14 projecting into the box-shaped body 6.

The two deformed portions 13 are positioned symmetrically relative to a plane P of symmetry on the respective lateral walls 8, 9 and are therefore opposite one another.

The plane P of symmetry is substantially parallel with the two walls 8, 9 and FIG. 5 illustrates its line.

The two deformed portions 14 are positioned symmetrically relative to the plane P on the respective lateral walls 8, 9 and are therefore opposite one another.

Figure 6:
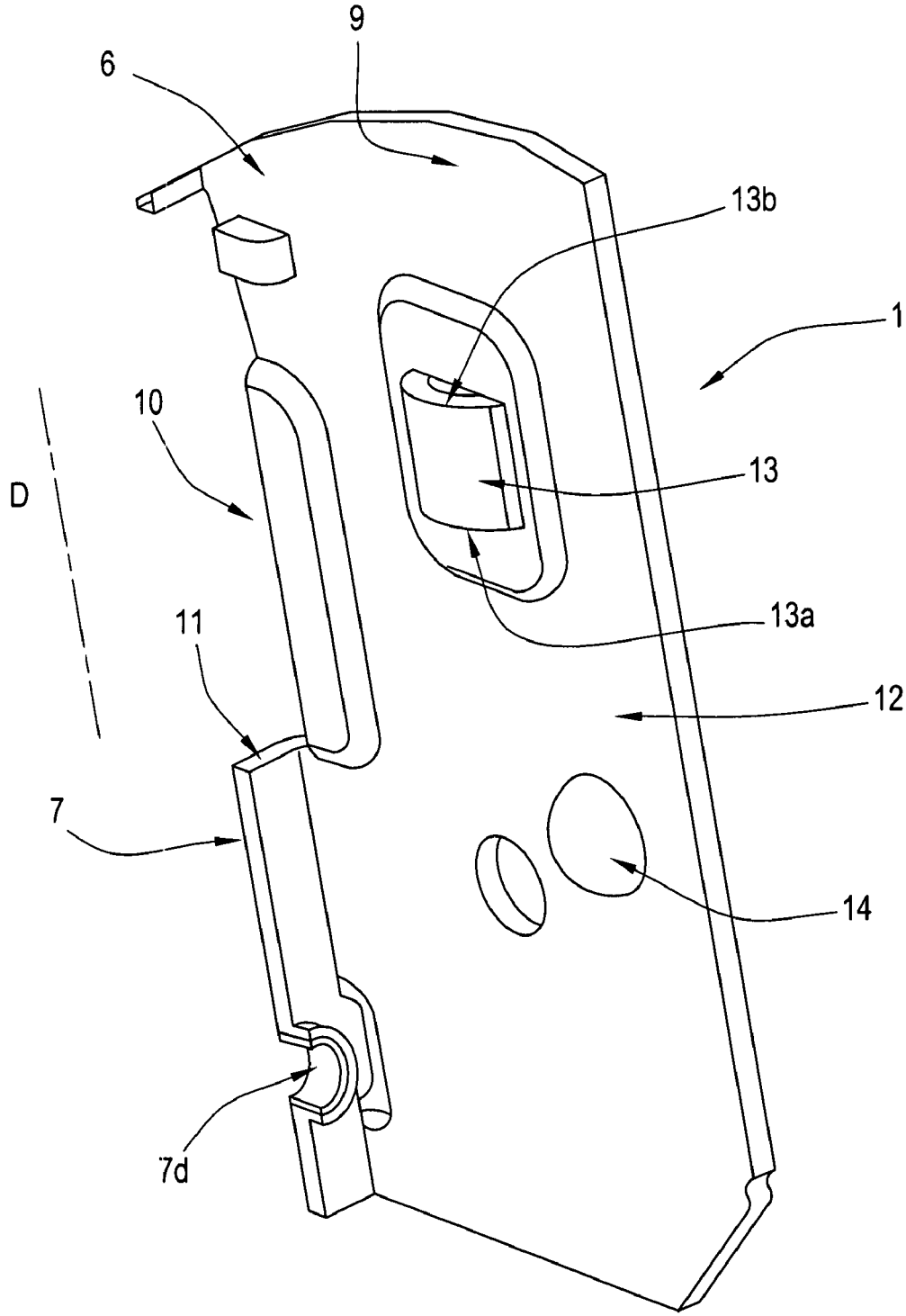
FIG. 6 is a schematic perspective view from a different angle, of a detail of the connection of FIG. 2.

With reference to FIG. 6, the first deformed portion 13 has the shape of a cylindrical segment, having directrices substantially parallel with the direction D.

The first deformed portion 13 is delimited, along the direction D, respectively by a lower sharp edge 13*a* and by an upper sharp edge 13*b*.

According to another embodiment, not illustrated, the first projecting deformed portion may have a single sharp edge. In that case the first deformed portion will have a shape different to the cylindrical segment, for example a conical portion.

As illustrated in FIGS. 2, 3 and 6, the first deformed portions 13 each form a stop element for the first element 3 of the hinge 2.

In practice, with the connection 1 assembled, the lower sharp edges 13*a* of the deformed portions 13 are drawn near one another and form a contact surface 15 for the upper side 3*b* of the first element 3 of the hinge 2, as illustrated in FIG. 5.

The two second deformed portions 14 are also positioned symmetrically opposite one another on the respective lateral walls 8, 9 of the box-shaped body 6 and are located below the first deformed portions 13, with reference to FIG. 5.

As illustrated in FIG. 6, each of the second deformed portions 14 has the shape of a spherical cap. The second portions 14 constitute guide elements for the first element 3 of the hinge 2, facilitating its insertion in the connection 1.

Inside the box-shaped body 6, the lateral wall 8 has a plurality of spacer elements 16, which keep the two lateral walls 8, 9 separate. The spacer elements 16 are preferably parallelepiped projections.

In practice, the connection 1 is connected to the oven 100 frame 102 using the fixing elements referred to but not illustrated, normally screws, which are inserted in the holes 7*c*, 7*d* in the base wall 7 of the connection 1.

Once the connection 1 is stably connected to the oven 100 frame 102, the first element 3 of the hinge 2 is inserted in the connection 1 through the opening 10 in the base wall 7 of the connection 1.

This operation is facilitated by the presence of the second deformed portions 14, which act as a guide for the first element 3 of the hinge 2 and facilitate its sliding thanks to their rounded shape.

Once inserted, the first element 3 of the hinge 2 is stably engaged in the connection 1.

As illustrated in FIGS. 2 and 5, the first deformed portions 13 create a contact surface 15 for the upper side 3*b* of the first element 3, whilst the notch made on the lower side 3*a* engages with the lower portion 11 of the base wall 7.

Starting with the configuration illustrated in FIG. 2, in which the element 3 is inserted in the box-shaped body 6, the fixing element 101 is positioned in contact with the base wall 7, to lock the element 3, as illustrated in FIG. 3.

In this way, the first element 3 is fixed to the connection 1 and the second element 4 of the hinge 2, which pivots at the first, rotates relative to it and consequently relative to the oven 100 frame 102, causing the door 5 to open and close.

The connection 1 is preferably made of sheet material.

The present invention therefore allows a hinge to be fixed in place for opening and closing the door of an oven or any other electrical appliance in an equivalent way to the prior art solutions, but introduces the fundamental advantage of being implemented in a single step, since the elements which engage with the hinge are part of the connection itself.

Therefore, no further assembly operations are required, which were previously needed to fit the rivets or the like, after forming.

As soon as it has been formed, the connection is therefore ready for packaging, thus significantly reducing production costs.

The invention described has evident industrial applications and may be modified and adapted in several ways without thereby departing from the scope of the inventive concept. Moreover, all details of the invention may be substituted by technically equivalent elements.

What is claimed is:

1. A connection for hinges having two elements which can rotate relative to one another, the connection being designed to stably engage with a first of said elements and comprising a box-shaped body having a base wall and two parallel lateral walls, wherein it is connectable to a fixed frame of an electrical appliance, wherein at least one of the lateral walls of the box-shaped body comprises a first deformed portion projecting into the box-shaped body, said first portion forming a stop element for the first of the two elements of the hinge, wherein each of the lateral walls comprises a respective first projecting deformed portion.

2. The connection according to claim 1, wherein the first deformed portions are opposite one another.

3. The connection for hinges according to claim 1, wherein at least one of the lateral walls comprises a second deformed portion projecting into the box-shaped body and forming a guide element for the first element, facilitating insertion of the latter in the box-shaped body.

4. The connection for hinges according to claim 3, wherein each of the lateral walls comprises a respective second deformed portion projecting into the box-shaped body.

5. The connection for hinges according to claim 4, wherein the second deformed portions are opposite one another.

6. The connection for hinges according to claim 3, wherein the second deformed portion has the shape of a spherical cap.

7. The connection for hinges according to claim 1, wherein the first deformed portion comprises at least one sharp edge.

8. The connection for hinges according to claim 1, wherein the first deformed portion has the shape of a cylindrical segment and has a first and a second sharp edge.

9. The connection for hinges according to claim 1, wherein the box-shaped body extends substantially longitudinally in a predetermined direction and has a substantially C-shaped cross-section.

10. The connection for hinges according to claim 1, wherein the box-shaped body is made of sheet metal.

* * * * *